US005461758A

United States Patent [19]

Yasuda et al.

[11] Patent Number: 5,461,758

[45] Date of Patent: Oct. 31, 1995

[54] ROLLER DEVICE FOR SENSING AND CONTROLLING UNEVENNESS OF SILVER IN A CARDING MACHINE

[75] Inventors: Hironori Yasuda; Katsumoto Yamamoto, both of Inazawa, Japan

[73] Assignee: Howa Machinery, Ltd., Nagoya, Japan

[21] Appl. No.: 304,832

[22] Filed: Sep. 13, 1994

[30] Foreign Application Priority Data

Sep. 14, 1993 [JP] Japan ..... 5-252505

[51] Int. Cl.[6] ..... D01H 5/38

[52] U.S. Cl. ..... 19/239; 19/288

[58] Field of Search ..... 19/106 R, 239, 19/240, 0.23, 260, 258, 152, 261, 268, 270, 288; 73/159, 160

[56] References Cited

U.S. PATENT DOCUMENTS

| | | | |
|---|---|---|---|
| 730,711 | 6/1903 | Slater | 19/288 |
| 3,703,023 | 11/1972 | Krauss et al. | 19/159 R X |
| 4,489,461 | 12/1984 | Hasegawa et al. | 19/288 X |
| 4,592,114 | 6/1986 | Stahlecker | 19/288 X |
| 4,646,387 | 3/1987 | Oswald et al. | 19/0.23 |
| 4,768,262 | 9/1988 | Gunter | 19/106 R X |

FOREIGN PATENT DOCUMENTS

| | | | |
|---|---|---|---|
| 0078393 | 5/1983 | European Pat. Off. | 19/288 |
| 54-38932 | 3/1979 | Japan . | |
| 59-6926 | 2/1984 | Japan . | |
| 59-28051 | 8/1984 | Japan . | |
| 6-25366 | 4/1994 | Japan . | |
| 0350881 | 10/1972 | U.S.S.R. | 19/240 |
| 1640224 | 4/1991 | U.S.S.R. | 19/261 |

*Primary Examiner*—Jeanette E. Chapman
*Assistant Examiner*—Ismael Izaguirre
*Attorney, Agent, or Firm*—Finnegan, Henderson, Farabow, Garrett & Dunner

[57] ABSTRACT

A short cycle unevenness control device in the delivery part of a carding machine. The device includes a set of measuring rollers 26 and 37 for receiving a sliver from a funnel and a set of drafting rollers 23 and 42 for issuing the sliver S to a coiler. The top measuring roller 37 is provided with an annular groove 36, while a bottom roller 26 is provided with an annular flange 25, which engages with the annular groove 36. The top drafting roller 42 is provided with an annular flange 41, while a bottom drafting roller 23 is provided with an annular groove 22, to which the flange 41 engages. Furthermore, the flange 41 of the top drafting roller 42 engages the groove 36 of the top measuring roller, while the flange 25 of the bottom measuring roller 46 engages the groove 22 of the bottom drafting roller 23.

9 Claims, 7 Drawing Sheets

ROLLER DEVICE FOR SENSING AND CONTROLLING UNEVENNESS OF SILVER IN A CARDING MACHINE

BACKGROUND OF THE INVENTION

1. Field of the Invention

The present invention relates to a roller device for controlling the unevenness of a sliver from a carding machine.

2. Description of Related Art

A carding machine with a device for controlling the unevenness of a sliver in a short cycle is known, where the device is arranged at a downstream side of a sliver delivery section of a card and is constructed as a set of a bottom and top measuring rollers, and a set of bottom and top drafting rollers. The measuring rollers are capable of being vertically displaced in relation to each other in accordance the thickness of a sliver passing between the rollers. Furthermore, a system is provided for controlling the rotational speed of the drafting rollers in accordance with the detected thickness of the sliver. As a result, a desired control of the drafting ratio (a ratio of the rotational speed of the drafting rollers with respect to the measuring rollers) is obtained, so as to obtain a sliver of a reduced unevenness. In the prior art, as shown in FIG. 7, one of the measuring rollers, for example, the top measuring roller is constructed as a roller with an annular groove, and the bottom measuring roller is constructed as a roller with a flange, which engages with the groove of the top measuring roller. Such a construction of the top and bottom measuring rollers is effective for preventing the sliver from being excessively widened at the measuring rollers, which is effective for reducing the unevenness at the measuring rollers.

However, in the prior art, the drafting rollers are a type with no flange and groove. In other words, the drafting rollers are constructed from a set of rollers of a flat surface. Such a flat construction of the drafting rollers causes an irregular drafting operation to be taken place, due to the fact that a widening of the sliver is not limited when it passes between the drafting rollers. Furthermore, in the prior art construction, foreign matter such as honeydews are apt to be attached to the surfaces of the measuring rollers and the drafting rollers, and a separate cleaning unit is necessary to clean these honeydews. Furthermore, in the prior art, in order to obtain a smooth threading of a sliver, a manual operation by an operator is essential so that the free end of the sliver is guided to the nip point of the drafting rollers.

SUMMARY OF THE INVENTION

An object of the present invention is to provide a roller device for controlling the unevenness of a sliver in a carding machine, capable of overcoming the above mentioned drawbacks in the prior art.

According to the present invention, a roller device is provided for controlling the unevenness in a carded sliver, which is arranged downstream from a sliver delivery part of the carding machine, comprising:

a first set of a first and second measuring rollers which are in contact with each other for providing a nip point adjacent the sliver delivery part;

a second set of a first and second drafting rollers which are in contact with each other for providing a nip point spaced from the nip point of the first set of the rollers;

the first and second measuring rollers in the first set being displaceable with respect to the nip point;

a sensor for providing a signal indicating the relative displacement of the measuring roller in the first set for controlling the rotating speed of the drafting rollers in the second set, the signal being used for controlling the rotating speed of the drafting rollers for obtaining a desired thickness of the sliver from the rollers of the second set;

said first measuring roller in the first set being formed with an annular flange, while the second measuring roller in the first set is formed with an annular groove, to which the annular flange in the first measuring roller is engaged, said first drafting roller in the second set being formed with an annular groove, while the second drafting roller in the second set is formed with an annular flange, which is engaged with the annular groove in the first drafting roller, said annular flange in the first measuring roller in the first set engaging with the annular groove in the first drafting roller in the second set, while, to the annular groove of the second measuring roller in the first set, the annular flange in the second drafting roller in the second set is engaged.

BRIEF EXPLANATION OF ATTACHED DRAWINGS

DESCRIPTION OF PREFERRED EMBODIMENT

Now, an embodiment of the present invention will be explained with reference to attached drawings.

Figure 6:
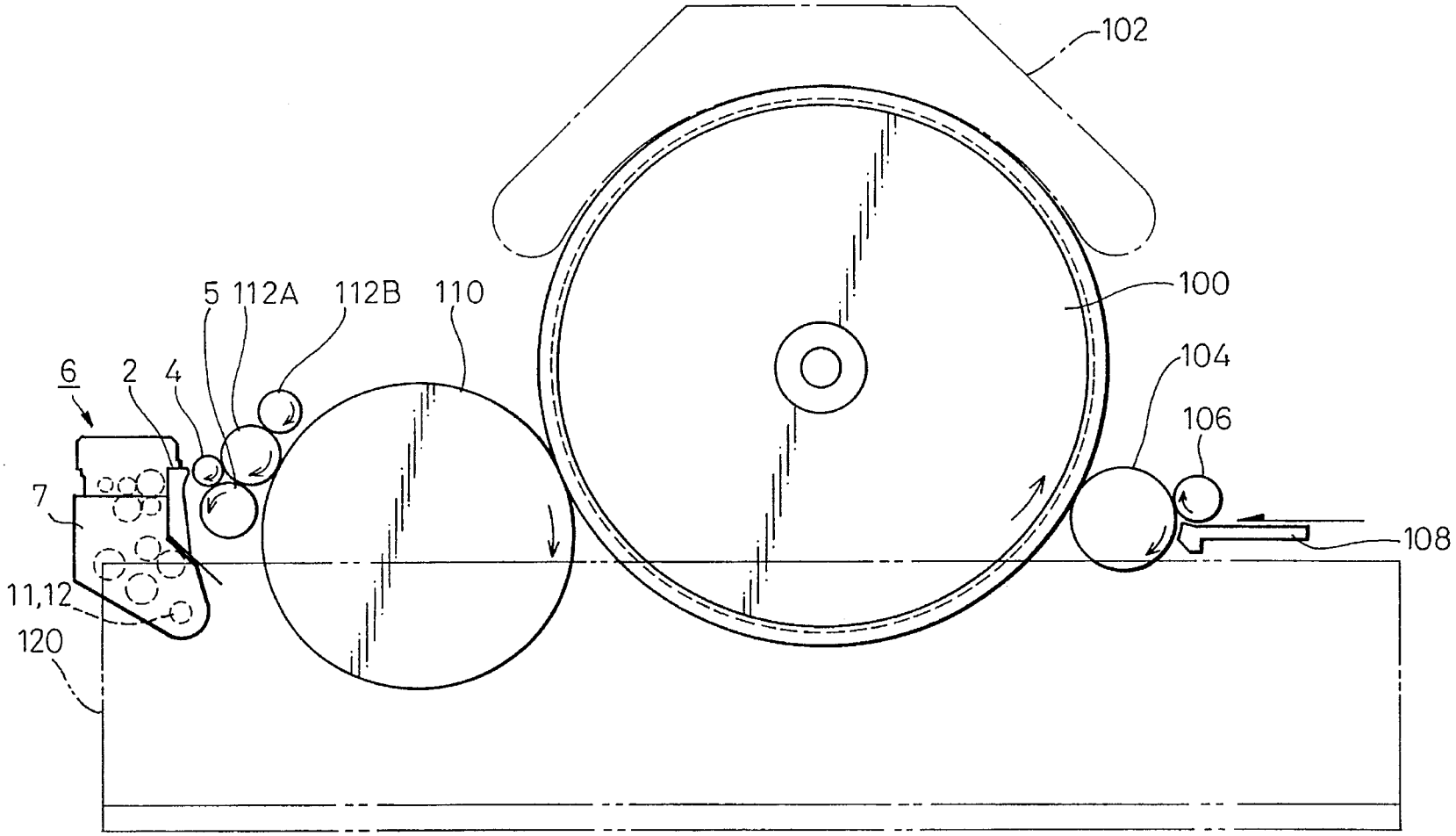
FIG. 6 is a schematic view of a carding machine provided with a roller device according to the present invention.

FIG. 6 shows generally a carding machine, which includes a cylinder 100, on which a card clothing is formed. A flat 102 as an endless card clothing is arranged to face the cylinder 100. A taker-in roller 104 is arranged so that it is in contact with the cylinder 100. Arranged upstream from the taker-in roller 104 is a feed roller 106 and a dish plate 108. Fiber from a fiber opening device (not shown) is received by the dish plate 108, and supplied to the taker-in roller 104 via the feed roller 106. A doffer 110 is arranged to face the cylinder 100, so that the fiber from the cylinder 100 is drawn off by the doffer 110. A set of stripping rollers 112A and 112B are arranged to be adjacent the doffer 110, so that a web of fiber is taken off the doffer 100 by the stripping rollers 112A and 112B. A set of delivery rollers 4 and 5 are arranged to face the stripping roller 112A, so that the fiber web is supplied to a delivery unit 6 of the card.

Figure 1:
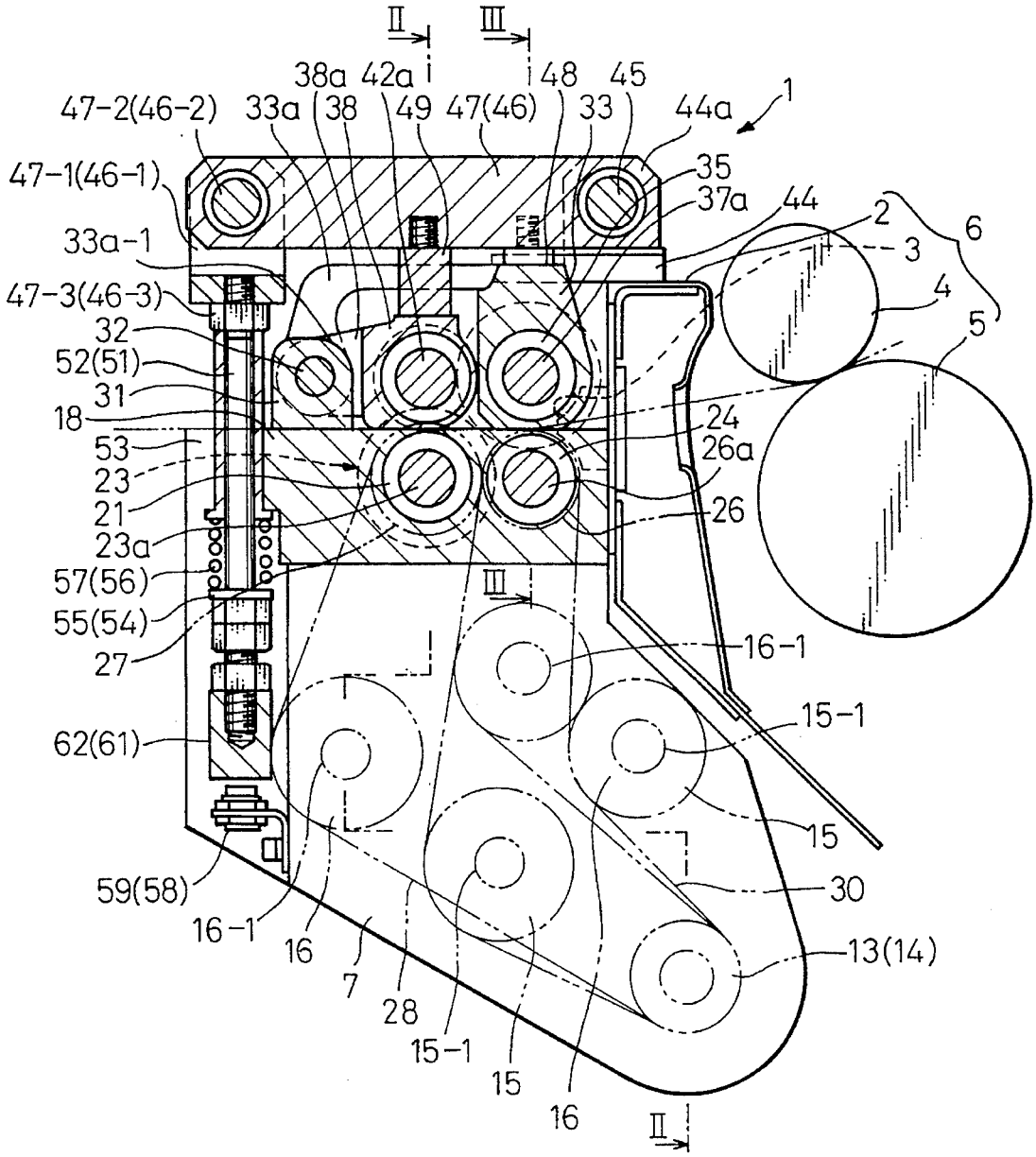
FIG. 1 is a transverse cross sectional view of the roller device for controlling a short cycle unevenness according to the present invention.
Figure 2:
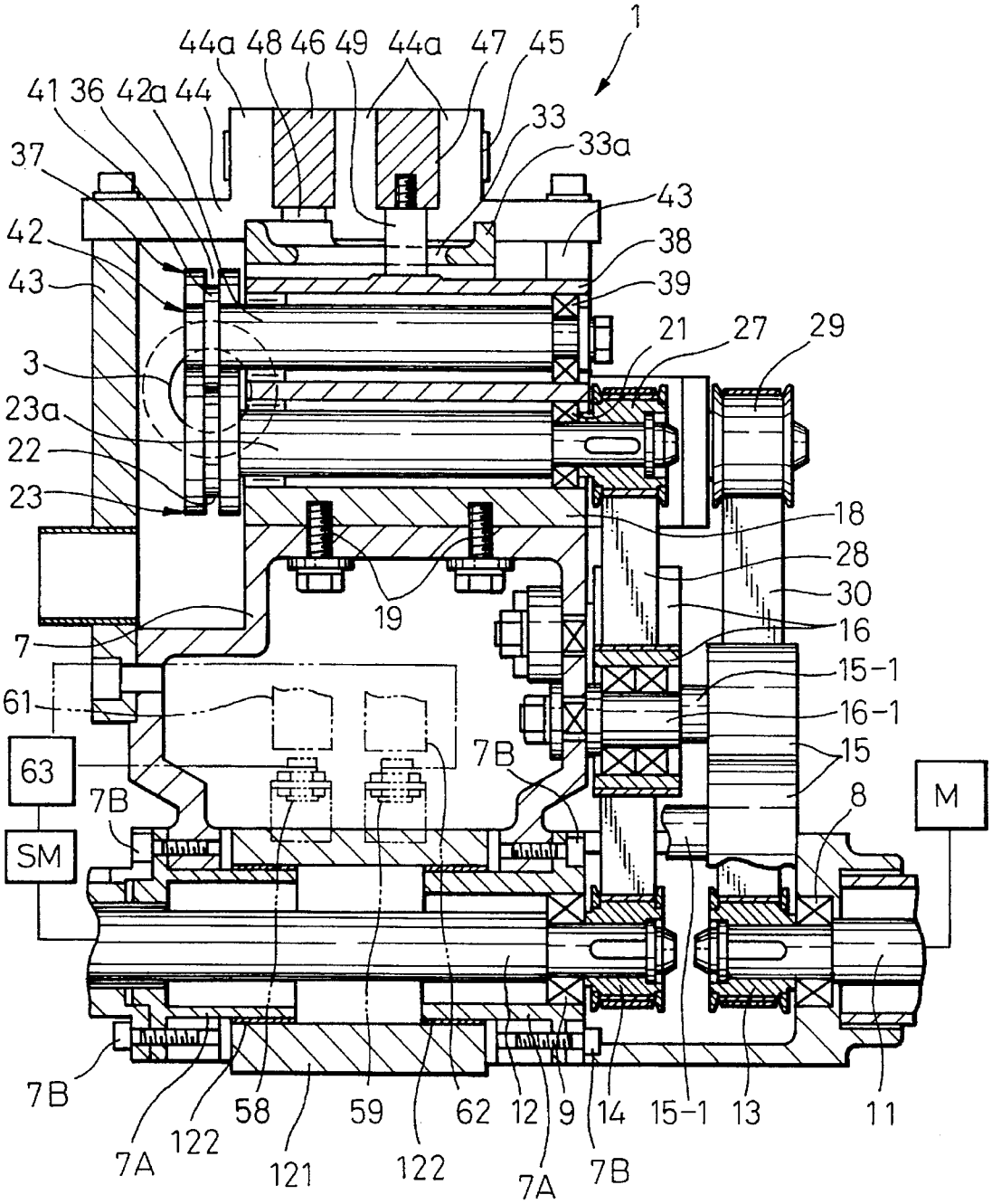
FIG. 2 is a longitudinal cross sectional view of the device along a line II—II in FIG. 1.

In FIG. 1, the sliver delivery part of a carding machine is shown. The card is provided with a high frequency irregularity control device according to the present invention. In FIG. 1, reference numeral 2 denotes a gatherer, 3 a funnel, and 4 and 5 delivery rollers. These parts 2, 3, and 4 and 5 construct, together with the doffer 100 and the stripping rollers 112A and 112B in FIG. 6, a sliver delivery part or device 6. The card is provided with a machine frame 120 (FIG. 6), on which a roller support body 7 as a hollow member is carried. Among these parts, the gatherer 2 and the funnel 3 which is integral to the gatherer are fixedly connected to the support member 7 which is per-se rotatable with respect to the machine frame as will be described later, while the delivery rollers 4 and 5 are rotatable with respect to the machine frame. Rotatably supported by the support body 7 at its bottom end via a roller bearing unit 8 is a drive shaft 11 (FIG. 2). The shaft 11 is drivingly connected, via a gear train (not shown), to an electric motor M, which is also drivingly connected to the rollers 4 and 5 of the sliver delivery part 6, via another gear train (not shown). Rotatably supported, also, by the support body 7 at its bottom end via a roller bearing unit 9 is a variable drive shaft 12 (FIG. 2). The variably driving shaft 12 is drivingly connected, via a gear train (not shown), to an electric servo motor SM.

The machine frame 120 in FIG. 6 has an integral or fixed sleeve portion 121 as shown in FIG. 2, to which a pair of axially spaced tubular shafts 7A are inserted via a pair of axially spaced sleeves 122. The sleeves 122, through which the drive shaft 12 concentrically passes, are connected to the support member 7 by means of bolts 7B. As a result, the support member 7 can be rotated about the axis of the drive shaft 12.

Transmission pulleys 13 and 14 are keyed to the shafts 11 and 12, respectively, at their faced ends. Located on one side of the roller supporting member 7 are guiding pulleys 15 in the same phase positions along respective horizontal axis. The guiding pulleys 15 have respective shafts 15-1 for rotatably supporting the respective pulleys 15 via respective bearing units. Located, also, on one side of the roller supporting member 7 are guiding pulleys 16 in same phase positions along the same phase positions along respective horizontal axis. The guiding pulleys 16 have respective shafts 16-1 for rotatably supporting the respective pulleys 16 via respective bearing units 16-1.

Figure 3:
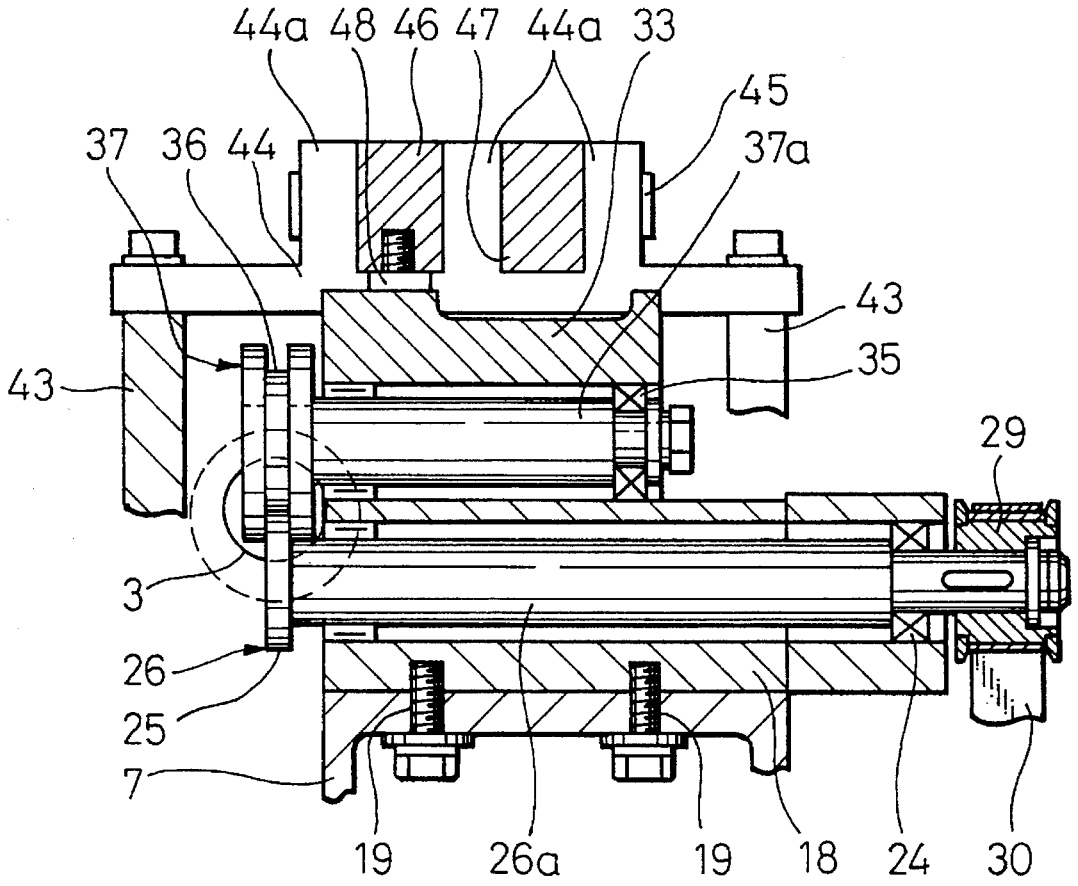
FIG. 3 is a longitudinal cross sectional view of the device along a line III—III in FIG. 1.

Arranged above the roller supporting body 7 is a bottom roller supporting member 18, which is fixedly connected to the body 7 by means of bolts 19 (FIG. 2). A supporting shaft 23*a* is rotatably supported to the member 18 by means of bearing units 21. The supporting shaft 23*a* has an end projected laterally out of the supporting member 18, which end forms a bottom draft roller 23 as a grooved roller of an increased diameter. The bottom draft roller 23 is formed with, along its outer periphery, an annular groove 22. Similarly, a supporting shaft 26*a* (FIG. 3) is rotatably supported by the member 18 by means of bearing units 24. As shown in FIG. 3, the supporting shaft 26*a* has an end projected laterally out of the supporting member 18, which end forms a flanged portion 25 as a bottom measuring roller 26 of an increased diameter. As shown in FIG. 2, at the end of the shaft 23*a* opposite the grooved bottom draft roller 23, projected out of the frame 18, a transmission pulley 27 is keyed. A belt 28 is, as shown in FIG. 1, looped between the transmission pulley 27 and the transmission pulley 14 on the variable drive shaft 12, via the guiding pulleys 16, so that a variable rotating movement of the variable drive shaft 12 is transmitted to the bottom drafting roller 23. As shown in FIG. 3, at the end of the shaft 26*a* opposite the bottom measuring roller 26, projected out of the frame 18, a transmission pulley 29 is keyed. A belt 30 is looped between the transmission pulley 29 and the transmission pulley 13 on the drive shaft 11, so that the rotational movement of the drive shaft 11 is transmitted to the bottom measuring roller 26.

Figure 4:
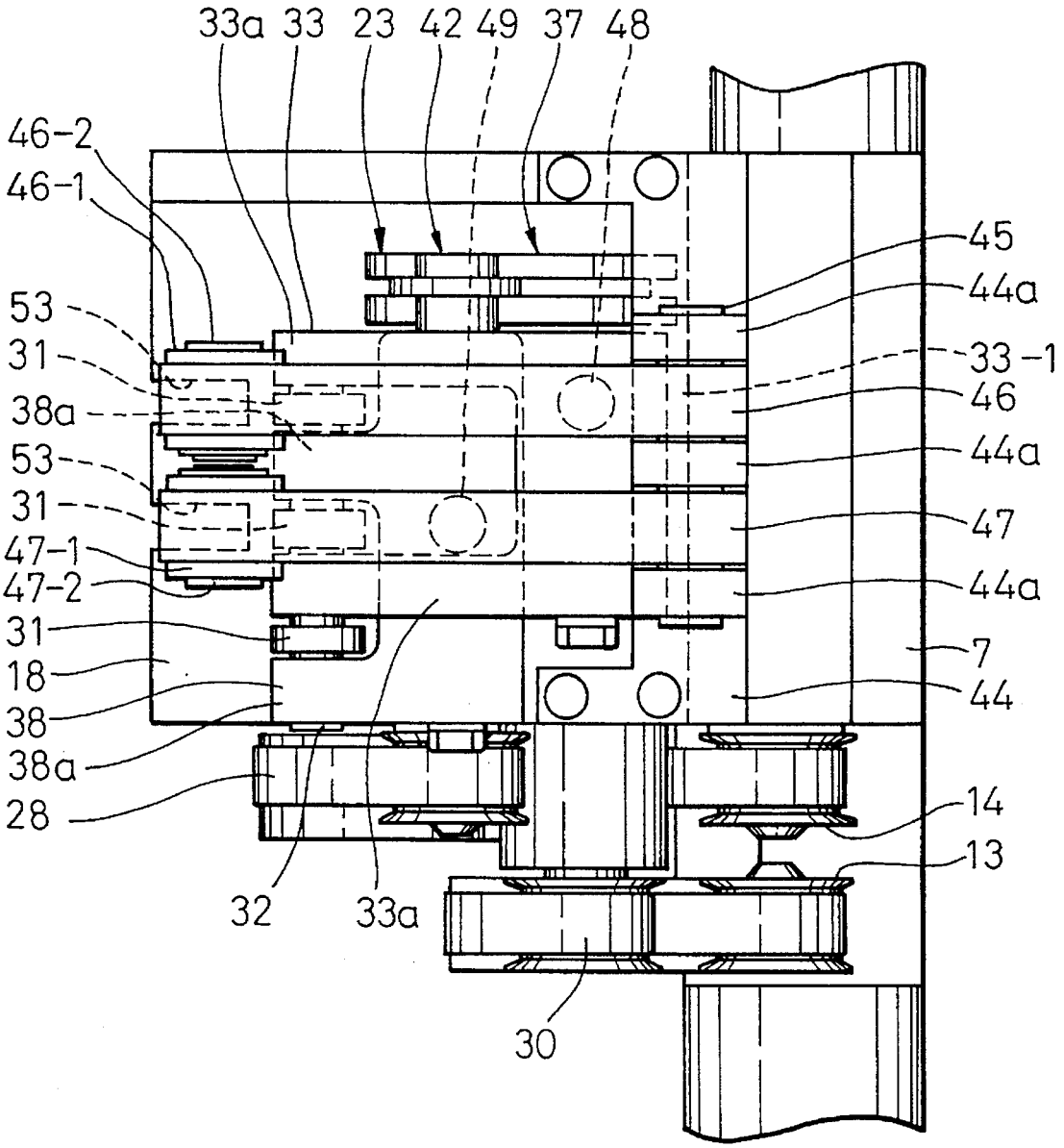
FIG. 4 is a plan view of the device in FIG. 1.
Figure 5:
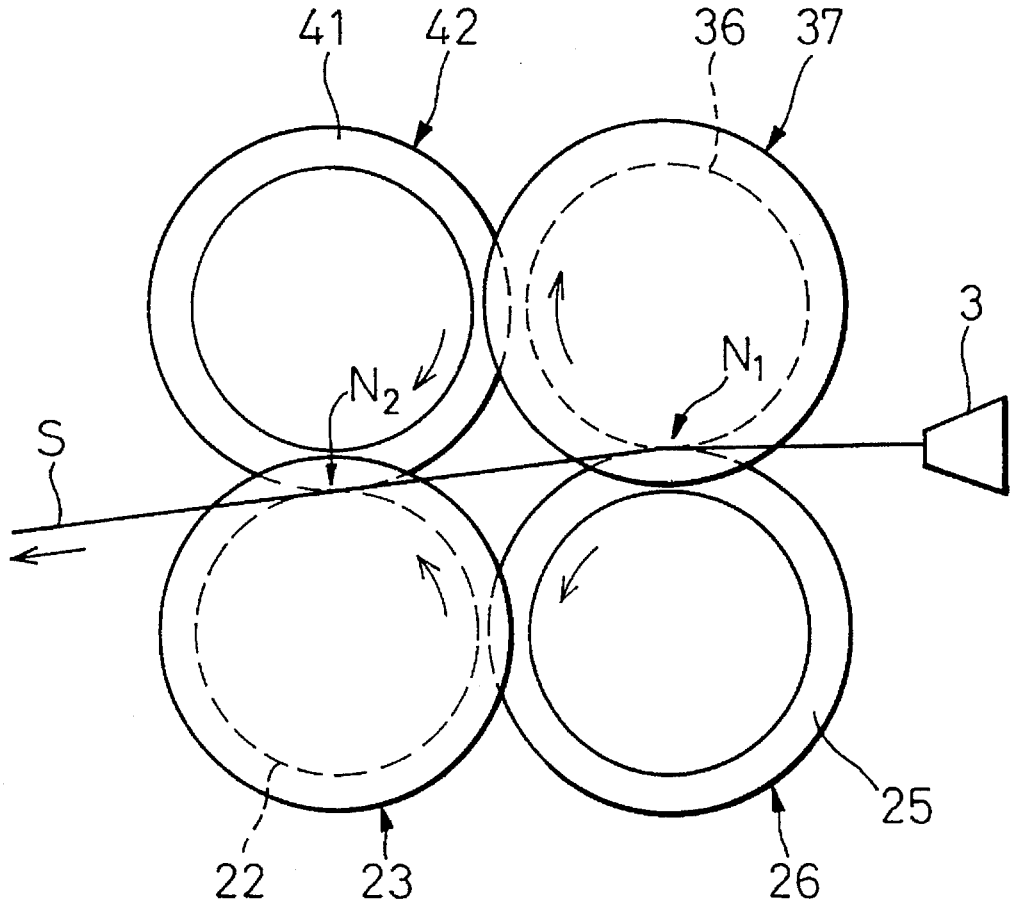
FIG. 5 is a schematic illustration of a relationship between a set of top and bottom measuring rollers and a set of top and bottom drafting rollers in the device in FIG. 1.

As shown, again, in FIGS. 1 and 4, on the bottom roller support 18, three support pieces 31 are fixedly connected. A fixed shaft 32 is connected between these supporting pieces 31. In FIG. 4, a reference numeral 33 denotes a top measuring roller supporting member, which is constructed by a tubular portion 33-1 extending axially and a pair of spaced apart rocking pieces 33*a* extending from the tubular portion 33-1 in a direction transverse to the axis of the rollers. As shown in FIG. 1, each rocking piece 33*a* forms a flattened C side elevational view, and has a ring shaped free end 33*a*-1, which is rotatably inserted to the fixed shaft 32, which allows the top measuring roller supporting member 33 to be pivoted about the shaft 32. As shown in FIG. 3, a support shaft 37*a* is rotatably supported on the supporting member 33 via bearing units 35. The supporting member 33 has an end projected out of the supporting member 33, on which end, a top measuring roller 37 as a grooved roller having an annular groove 36 is fixed. Furthermore, as shown in FIG. 4, a top draft roller supporting member 38 of a substantially F shaped top elevational view is provided. The top roller supporting member 38 has a pair of axially spaced apart arm portions 38*a*, which are, also, rotatably supported by the fixed shaft 32, so that the top draft roller supporting member 38 can be rocked about the axis of the shaft 32. As shown in FIG. 2, a top draft roller supporting shaft 42*a* is rotatably supported to the top draft roller supporting member 38 via bearing units 39. The shaft 42*a* has an end projected out of the support 38, to which end a top draft roller 42 as a roller with flange 41 is integrally formed. As shown in FIG. 5, under an operating condition as shown in FIG. 5, between the measuring rollers 26 and 37, the stepped or flange portion 25 of the bottom measuring roller 26 engages with the annular groove 36 of the top measuring roller 37. See also FIG. 3. Similarly, in FIG. 5, between the drafting rollers 23 and 42, the stepped or flange portion 41 of the top drafting roller 42 engages with the annular groove 22 of the bottom drafting roller 23, as also shown in FIG. 2. Furthermore, the arrangement of the sets of the top and bottom measuring rollers 26 and 37 and the top and bottom drafting rollers 23 and 42 are, in the direction of the feed of the sliver, such that, as shown in arrows in FIG. 5, the flange portion 41 of the top drafting roller 42 engages with the annular groove portion 36 of the top measuring roller 37, and the flange portion 25 of the bottom measuring roller 26 engages with the annular groove 22 of the bottom drafting roller 23.

As shown in FIG. 2, a pair of side plates 43 are connected to opposite side walls of the roller support body 7. Connected to the side plates 43 is an arm supporting member 44, which is formed with three arms supporting pieces 44*a*. A fixed shaft 45 is mounted to the arm supporting pieces 44*a*. A first rocking arm 46 and a second rocking arm 47 are, at their base ends, rotatably supported via respective bearings. A first presser block 48 is screwed to the bottom surface of the first rocking arm 46 at a location facing the top draft roller supporting body 38. A second presser block 49 is screwed to the bottom surface of the second rocking arm 47 at a location facing the top measuring roller supporting body 33. The first and second rocking arms 46 and 47 have respective free ends, to which respective connecting blocks 46-1 and 47-1 are rotatably connected via respective pins 46-2 and 47-2. First and second vertically moving bars 51 and 52 inserted through respective sleeves 51A and 52A are, at their respective upper ends, screwed to the respective connecting blocks 46-1 and 47-1 and locked by respective nuts 46-3 and 47-3. The first and second bars 51 and 52 together with the respective sleeves 51A and 51B are, at their respective middle portions, passed through cut out portions 53, respectively formed in the bottom roller supporting member 18. Furthermore, compression springs 56 and 57 are arranged between respective flange portions 54 and 55 thereof and flanges of the respective sleeves 51A and 51B contacting the bottom roller supporting body 18. The compression springs 56 and 57 cause the respective first and second bars 51 and 52 to be urged to move downwardly, so that the first and second arms 46 and 47 are spring urged to be rotated in counter clockwise direction about the fixed shaft 45. As a result, the presser blocks 48 urge the top measuring roller supporting member 33 to be rotated in clockwise direction about the fixed shaft 32 to cause the top measuring roller 37 to be resiliently contacted with the bottom measuring roller 26, while the presser blocks 49 urge the top drafting roller supporting member 38 to be rotated in clockwise direction about the fixed shaft 32 to cause the top drafting roller 42 to be resiliently contacted with the bottom drafting roller 23. As a result, in accordance with the thickness of the sliver passing between the top and bottom measuring rollers 37 and 26 and between the top and bottom drafting rollers 42 and 23, the top measuring roller support 33 and the top drafting roller support 38 are moved "upwardly" or "downwardly" due to the fact that the arms 33*a* and 38*a* are rotated about the axis of the fixed shaft 32. This rocking movement of the arms 33*a* and 38*a* causes the arms 46 and 47 to be rotated about the axis of the fixed shaft 45, so that the rods 51 and 52 are moved upwardly against the force of the springs 56 and 57, respectively, or moved downwardly by the force of the vertically springs 56 and 57, respectively. As shown in FIG. 1, first and second detecting pieces 61 and 62 are screwed to bottom ends of the bars 51 and 52, respectively. First and second distance sensors 58 and 59 are fixedly connected to suitably locations on the roller support body 7, in such a manner that the sensors 58 and 59 face the pieces 61 and 62, respectively. These sensors 58 and 59 detect the vertical positions of the bars 51 and 52, respectively, which correspond to the thickness of the sliver being passed between the measuring rollers 26 and 37 and between the drafting rollers 23 and 42. As shown in FIG. 2, these distance sensors 58 and 59 are connected to a control circuit 63, so that the detecting signals from the sensors are supplied to the circuit. The control circuit 63 issues a signal directed to the servomotor SM for controlling the speed of the variable-speed drive shaft 23.

According to the invention, the gatherer 2, the support member 7, the bottom roller support 18, the top measuring roller support 33, the top drafting roller support 33, the arms 46 and 47, and the rods 51 and 52 et al construct an assembly. Since the support member 7 is rotatable about the axis of the drive shaft 12 (FIG. 2), the assembly is also rotatable about the axis of the shaft 12. Namely, the assembly is usually in a operating position as shown in FIG. 1, where the gatherer 2 is located to face the delivery rollers 4 and 5 to receive a web therefrom. However, during a cleaning operation, the assembly can be retracted from the normal position in a counter clockwise direction to a rest position, where the gatherer 2 is opened upwardly, which allows the assembly to be accessed to remove fly or dirt.

Now, an operation of the apparatus according to the present invention will be explained. During an operation of the card, the fixed speed motor M generates a fixed speed rotating movement transmitted to the doffer 100, the stripping rollers 112A and 112B, the pair of the feed rollers 4 and 5, and bottom measuring rollers 26 via respective transmission trains (not shown) under respective gear ratios. Contrary to this, the servomotor SM generates a variable speed rotating movement, which is transmitted to the bottom drafting roller 23 with a desired speed ratio, so that a desired drafting ratio is obtained, as a ratio of rotational speed of the bottom drafting roller 23 to that of the bottom measuring roller 26. A widened fleece taken from the doffer by means of the stripper 112A is issued from the supply rollers 4 and 5, and is collected at the gatherer 2 so as to form a sliver S (FIG. 5), which issues from the funnel 3. The sliver is then passed between the bottom and top measuring rollers 26 and 37, and between the bottom and top drafting rollers 23 and 42. The sliver S subjected to a drafting process between the measuring rollers 26 and 37, and the drafting rollers 23 and 42 is finally moved to a coiler device (not shown), so that the sliver S is stored in a can in a coiled state.

During the drafting operation of the sliver, when a sliver is passed between the bottom and top measuring rollers 26 and 37, an unevenness in thickness in the sliver before it is subjected to the drafting process causes the top measuring roller 37 to be vertically moved with respect to the bottom measuring roller 26, which causes the top measuring support 33 to be rocked about the axis of the shaft 32 via the arm 33*a*, so that the first presser block 48 presses the first rocking arm 46 to be rocked about the axis of the shaft 45, which causes the first bar 51 to be vertically reciprocated together with the detecting piece 61. During this vertical reciprocating movement of the bar 51, the sensor 58 responds to the distance with respect to the detected piece 61 to issue a signal corresponding to the thickness of the sliver S passing between the bottom and top measuring rollers 26 and 37. From this measuring signal, the control circuit 63 issues a speed signal directed to the servo-motor SM, which causes the rotational speed of the bottom drafting roller 23 to be varied to the one that can obtain a desired constant thickness of the sliver at the drafting roller 23. Namely, the drafting ratio of the set of the drafting rollers 23 and 42 with respect to the set of the measuring rollers 26 and 37 is varied to obtain the desired thickness of the sliver.

In addition, when the sliver is passing between the set of the drafting rollers 23 and 42, an unevenness in the thickness of the sliver causes the top draft roller 42 to be vertically moved, which causes the support 38 to be rocked about the axis of the shaft 32, which causes the presser 49 pushes the arm 47, so that the second rocking arm 47 is rocked about the axis of the shaft 45, which causes the second bar 52 to be vertically moved together with the detecting piece 62. During this vertical reciprocating movement of the bar 52, the sensor 59 responds to the distance with respect to the detected piece 62 to issue a signal corresponding to the thickness of the sliver passing between the bottom and top drafting rollers 23 and 42. From this measuring signal, the control circuit 63 issues a speed signal directed to the servo-motor SM, which causes the rotational speed of the bottom drafting roller 23 to be varied to one that can obtain a desired constant thickness of the sliver at the drafting roller 23.

According to the present invention, the top drafting roller 42 is formed with the flange 41, while the bottom drafting roller 23 is formed with annular groove 22, to which the flange 41 of the top drafting roller 42 is engaged. The sliver is passed between the flange 41 and the groove 22. This engaging construction is effective in that the sliver S is prevented from being widened unnecessarily manner, thereby preventing unevenness of the sliver from being generated. Furthermore, the flange portion 41 of the top drafting roller 42 is introduced or engaged with the annular groove 36 of the top measuring roller 37, while, to the annular groove 22 of the bottom drafting roller 23, the stepped or flange portion 25 of the bottom measuring roller 26 is introduced. Furthermore, the engaged set of the top measuring roller 37 and top drafting roller 42 rotate in the opposite direction, and the engaged set of the bottom measuring roller 26 and bottom drafting roller 23 also rotate in the opposite direction, as shown by arrows in FIG. 5. As a result, a self cleaning operation of the measuring rollers 26 and 37 and the drafting rollers 23 and 42 is obtained without provision of any conventional separate cleaning device due to the fact that any foreign matter such as honeydews attached to the rollers are wiped by the engaged set of the top measuring roller 37 and top drafting roller 42 rotating in the opposite directions as well as by the engaged set of the bottom measuring roller 26 and bottom drafting roller 23 rotating in the opposite directions.

Furthermore, a setting of a distance between the nip point $N_1$ (FIG. 5) of the measuring rollers 26 and 37 and the nip point $N_2$ of the drafting rollers 23 and 42 can be very short. As a result, the threading of a sliver S is eased when an interrupted carding operation is restarted. Namely, even in a situation where the free end of a newly introduced sliver comes from the nip point $N_1$ of the top and bottom measuring rollers 37 and 26 and is directed upwardly or downwardly, with respect to the horizontal line, the sliver end can be positively guided to the nip point $N_2$ between the top and bottom drafting rollers 42 and 23, thereby allowing the threading of the sliver to be suitable for an automated operation. Furthermore, according to the present invention, the drafting rollers 23 and 42 are, as are the measuring rollers 26 and 37, formed as a engaging set of a flange roller and a grooved roller which are vertically displaceable, on one hand, and a second distance sensor 59 is provided for detecting the relative displacement of the drafting rollers. As a result, a compact construction of the short cycle unevenness control unit is realized in the direction of a supply of the sliver, while allowing an unevenness of the sliver to be detected after being subjected to the drafting process.

Figure 7:
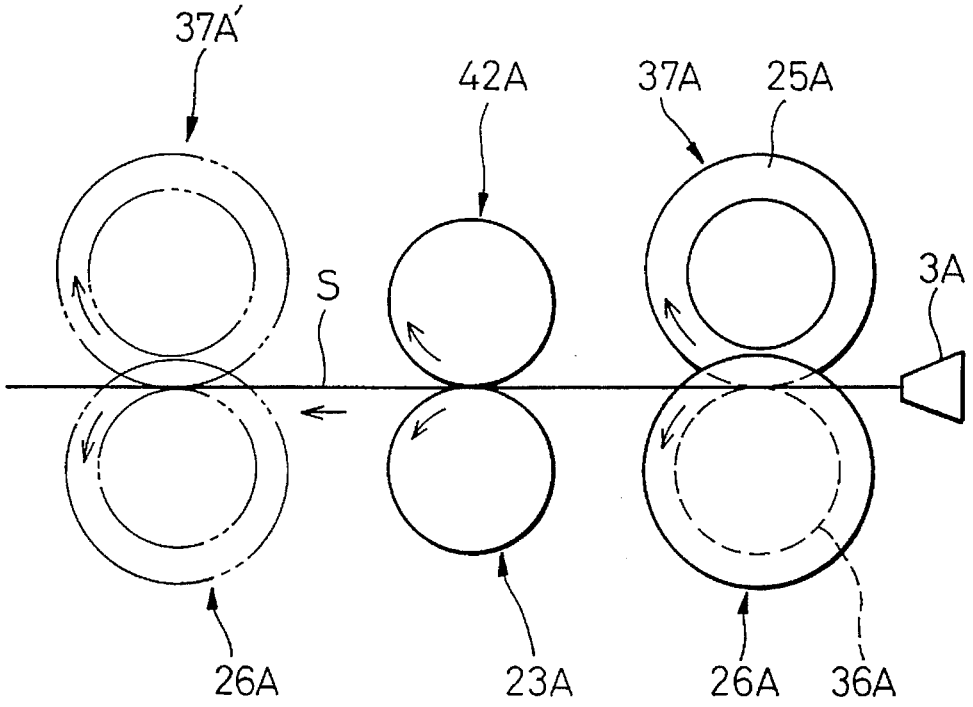
Fig.7 (Prior Art)
FIG. 7 is similar to FIG. 5, but illustrates a construction in the prior art.

FIG. 7 schematically shows an arrangement of a drafting roller assembly for controlling unevenness in the prior art. In the prior art, as far as the measuring roller set is concerned, a top measuring roller 37 is provided with a flange 25A, which is engaged with an annular groove 36A of the bottom measuring roller 26A. However, the drafting roller set, which is spaced from the measuring roller set, is constructed by plain top and bottom rollers 42A and 23A. Such a plane construction of the drafting rollers 23A and 42A can cause an irregular drafting operation to take place, due to the fact that a widening of the sliver is not limited when the sliver passes between the drafting rollers 23A and 42A. Furthermore, in the prior art construction, foreign matter, such as honeydews, is apt to be attached to the surfaces of the measuring rollers 26A and 37A and the drafting rollers 23A and 42A, and a separate cleaning unit is necessary to remove these honeydews. Furthermore, when a threading of a sliver is done, the free end of the sliver after passed through the nip point of the measuring rollers 26A and 37A is apt to be directed upwardly or downwardly with respect to the horizontal line which causes the sliver to be wound on the drafting rollers 23A and 42A instead of passing between the rollers 23A and 42A due to the fact that the drafting rollers 23A and 42A are distant from the measuring rollers 26A and 37A. Thus, in the prior art, a manual operation by an operator is essential so that the free end of the sliver is guided to the nip point of the drafting rollers 23A and 42A. Furthermore, when detection of the sliver unevenness after the drafting rollers 23A and 42A is necessary, an additional set of measuring rollers 26A' and 37A' becomes necessary. Else, calendar rollers in a coiler device (not shown) downstream from the drafting roller unit are constructed as measuring rollers, which makes the system large and complicated.

In the embodiment, an arrangement of the measuring rollers 26 and 27 and/or the drafting rollers 23 and 42 can be reversed.

While an embodiment of the present invention is described with reference to the attached drawings, many modifications and changes can be made by those skilled in this art without departing from the scope and spirit of the present invention.

We claim:

1. A device for controlling unevenness in a carded sliver, which device is located downstream from a sliver delivery part of a carding machine, comprising:

a first set of a first and a second measuring roller, which measuring rollers are in contact with each other and provide a first nip point adjacent the sliver delivery part;

a second set of a first and a second drafting roller, which drafting rollers are in contact with each other and provide a second nip point spaced from the first nip point of the first set of rollers;

at least one-of said first and the second measuring rollers in the first set being displaceable with respect to said first nip point;

a sensor for detecting relative displacement of a measuring roller in the first set to indicate the thickness of a sliver passing through said first nip point and means, responsive to a signal from the sensor, for obtaining a desired thickness of a sliver from the rollers of the second set;

said first measuring roller in the first set being formed with an annular flange, while the second measuring roller in the first set is formed with an annular groove, which groove is engaged with the annular flange of the first measuring roller, said first drafting roller in the second set being formed with an annular groove, while the second drafting roller in the second set is formed with an annular flange, which flange is engaged with the annular groove of the first drafting roller, and said annular groove of the first drafting roller in the second set being engaged with the annular flange of the first measuring roller in the first set, while the annular flange of the second drafting roller in the second set is engaged with the annular groove of the second measuring roller in the first set.

2. The device of claim 1, wherein at least one of said drafting rollers in the second set is also displaceable with respect to said second nip point, said device further comprising a second sensor providing a signal for indicating the relative displacement of a drafting roller in the second set, the signal controlling the rotating speed of the drafting rollers for obtaining a desired thickness of a sliver from the rollers of the second set.

3. The device of claim 1, further comprising a support member for mounting thereon the first and second sets of rollers, and a shaft for rotatably supporting the support member to allow the support member together with the first and second sets of rollers to be retracted from the carding machine, said shaft for rotatably supporting the support member being concentrically arranged with respect to a shaft for driving the rollers.

4. The device of claim 3, further comprising a gatherer for gathering fleece from the carding machine to create a sliver, the gatherer being connected to the support member.

5. The device of claim 3, further comprising a bottom roller support member on which a bottom measuring roller of said first set and a bottom drafting roller of said second set are rotatably mounted, a top measuring roller support for rotatably supporting a top measuring roller of said first set, a top drafting roller support for rotatably supporting a top drafting roller of said second set, the top measuring roller support and the top drafting roller support allowing the top measuring roller and the top drafting roller to be displaced relative to said bottom measuring roller and said bottom drafting roller, respectively, swing arms having first ends rotatably mounted about a fixed axis and second ends spaced from the first ends, said swing arms being connected to the top measuring roller support and the top drafting roller support, respectively, between said first and second ends, bars having first ends connected to the second ends of the swing arms, respectively, and second ends connected to the support member, and springs for urging the arms respectively, so that the top measuring and drafting rollers are pressed toward the bottom measuring and drafting rollers respectively.

6. The device of claim 5, wherein said sensor senses the displacement of the bar connected to the swing arm that is connected to the top measuring roller support to indicate the thickness of a sliver passing through the first nip point of the measuring rollers.

7. The device of claim 6, further comprising a second sensor providing a signal for indicating the relative displacement of a drafting roller in the second set, the signal controlling the rotating speed of the drafting rollers for obtaining a desired thickness of a sliver from the rollers of the second set, said second sensor sensing the displacement of the bar connected to the swing arm that is connected to the top drafting roller support to indicate the thickness of a sliver passing through the second nip point of the drafting rollers.

8. A carding machine comprising:

a cylinder having a card clothing thereon;

a taker-in roller for introducing fibers onto the cylinder;

a flat arranged to cooperate with the cylinder for carding the fibers with respect to the cylinder;

a doffer roller arranged to cooperate with the cylinder for removing the carded fibers from the cylinder;

a stripping roller arranged to cooperate with the doffer roller for taking the fibers from the doffer roller;

delivery rollers arranged to cooperate with the stripping roller for creating a fleece of the fibers;

a gatherer arranged downstream from the delivery rollers for gathering the fleece from the delivery rollers into a sliver;

a funnel located downstream from the gatherer for guiding the sliver, and;

a device arranged downstream from the funnel for controlling the thickness of the sliver, said controlling device comprising:

a first set of a first and a second measuring roller, which measuring rollers are in contact with each other and provide a first nip point for a sliver from the funnel and which are relatively displaceable with respect to each other in accordance with the thickness of a sliver passing through the first nip point;

a second set of a first and a second drafting roller which rollers are in contact with each other and provide a second nip point spaced from the first nip point of the first set of rollers;

a sensor for detecting relative displacement of a measuring roller in the first set to indicate the thickness of a sliver passing through said first nip point of the measuring rollers, and;

means, responsive to a signal from the sensor, for controlling the rotating speed of the drafting rollers in the second set for obtaining a desired thickness of a sliver from the rollers of the second set;

said first measuring roller in the first set being formed with an annular flange, while the second measuring roller in the first set is formed with an annular groove, which groove is engaged with the annular flange of the first measuring roller, said first drafting roller in the second set being formed with an annular groove, while the second drafting roller in the second set is formed with an annular flange, which flange is engaged with the annular groove of the first drafting roller, and said annular flange of the first measuring roller in the first set being engaged with the annular groove of the first drafting roller in the second set while the annular groove of the second measuring roller in the first set is engaged with the annular flange of the second drafting roller in the second set.

9. The carding machine of claim 8, wherein said drafting rollers in the second set are also displaceable in respect to each other in accordance with the thickness of a sliver passing through the said second nip point, said device further comprising a second sensor for detecting relative displacement of a drafting roller in the second set to indicate the thickness of a sliver passing through the drafting rollers, and means, responsive to a signal from the second sensor, for controlling the rotating speed of the drafting rollers for obtaining a desired thickness of the sliver from the rollers of the second set.

* * * * *

UNITED STATES PATENT AND TRADEMARK OFFICE

CERTIFICATE OF CORRECTION

PATENT NO. : 5,461,758

DATED : October 31, 1995

INVENTOR(S) : Hironori Yasuda et al.

It is certified that error appears in the above-indentified patent and that said Letters Patent is hereby corrected as shown below:

On the Title page, item [54]; and in col. 1, line 2: change "SILVER" TO —SLIVER—.

Signed and Sealed this

Twentieth Day of February, 1996

*Attest:*

*Attesting Officer*

BRUCE LEHMAN

*Commissioner of Patents and Trademarks*